US006675585B2

(12) United States Patent
Calvez et al.

(10) Patent No.: US 6,675,585 B2
(45) Date of Patent: Jan. 13, 2004

(54) CONNECTION FOR A TWO-PART CMC CHAMBER

(75) Inventors: Gwénaëlle Calvez, Melun (FR); Eric Conete, Merignac (FR); Alexandre Forestier, Boissise la Bertrand (FR); Didier Hernandez, Quiers (FR)

(73) Assignee: SNECMA Moteurs, Paris (FR)

( * ) Notice: Subject to any disclaimer, the term of this patent is extended or adjusted under 35 U.S.C. 154(b) by 43 days.

(21) Appl. No.: 10/161,662

(22) Filed: Jun. 5, 2002

(65) Prior Publication Data

US 2002/0184888 A1 Dec. 12, 2002

(30) Foreign Application Priority Data

Jun. 6, 2001 (FR) ..... 01 07372

(51) Int. Cl.[7] ..... F02C 7/20
(52) U.S. Cl. ..... 60/796; 60/753; 60/800
(58) Field of Search ..... 60/753, 796, 798, 60/800

(56) References Cited

U.S. PATENT DOCUMENTS

| | | | | |
|---|---|---|---|---|
| 2,509,503 A | | 5/1950 | Huyton | |
| 4,030,875 A | | 6/1977 | Grondahl et al. | |
| 5,181,377 A | * | 1/1993 | Napoli et al. | 60/796 |
| 5,291,733 A | * | 3/1994 | Halila | 60/796 |
| 5,343,694 A | * | 9/1994 | Toborg et al. | 60/796 |
| 5,524,430 A | | 6/1996 | Mazeaud et al. | |
| 5,564,271 A | * | 10/1996 | Butler et al. | 60/796 |
| 6,131,384 A | | 10/2000 | Ebel | |
| 6,334,298 B1 | * | 1/2002 | Aicholtz | 60/796 |
| 6,397,603 B1 | * | 6/2002 | Edmondson et al. | 60/753 |
| 6,497,104 B1 | * | 12/2002 | Thompson et al. | 60/796 |

FOREIGN PATENT DOCUMENTS

| | | |
|---|---|---|
| EP | 1 035 377 | 9/2000 |
| GB | 2 035 474 | 6/1980 |
| GB | 1 570 875 | 7/1980 |

* cited by examiner

*Primary Examiner*—Michael Koczo
(74) *Attorney, Agent, or Firm*—Oblon, Spivak, McClelland, Maier & Neustadt, P.C.

(57) ABSTRACT

A turbomachine has inner and outer annular shells of metal material containing, in a gas flow direction F, a fuel injector assembly, a composite material annular combustion chamber, and an nozzle of metal material forming the fixed-blade inlet stage of a high pressure turbine. Provision is made for the combustion chamber to be held in position between the inner and outer metal annular shells by a plurality of flexible metal tabs having first ends interconnected by a flange-forming metal ring fixed securely to each of the annular shells by first fixing means, and second ends fixed by second fixing means firstly to the composite material combustion chamber and secondly to one end of a composite material wall whose other end forms a bearing plane for a sealing element secured to the nozzle and providing sealing for the gas stream between the combustion chamber and the nozzle.

9 Claims, 2 Drawing Sheets

FIG.1A
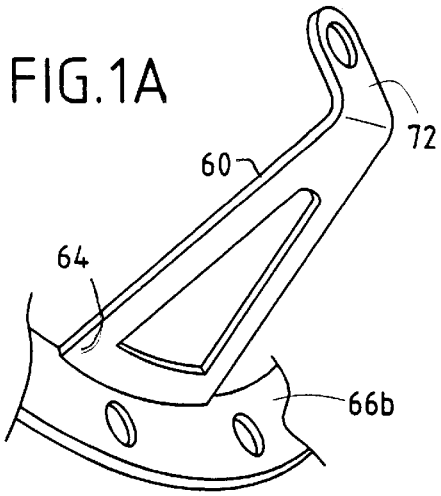
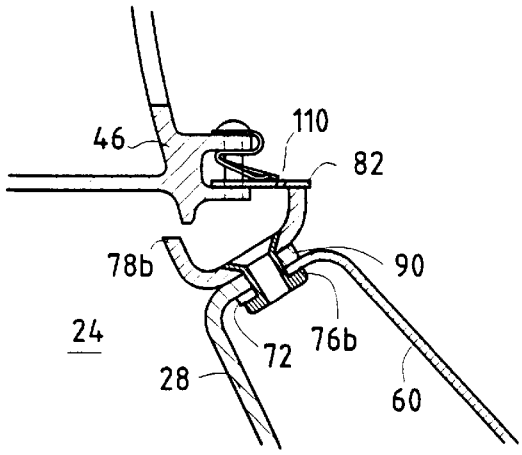
FIG.1B
FIG.2
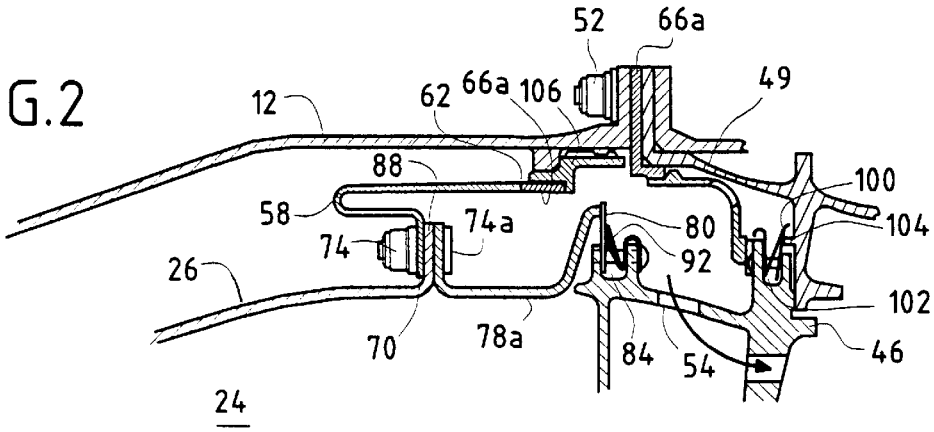
FIG.3
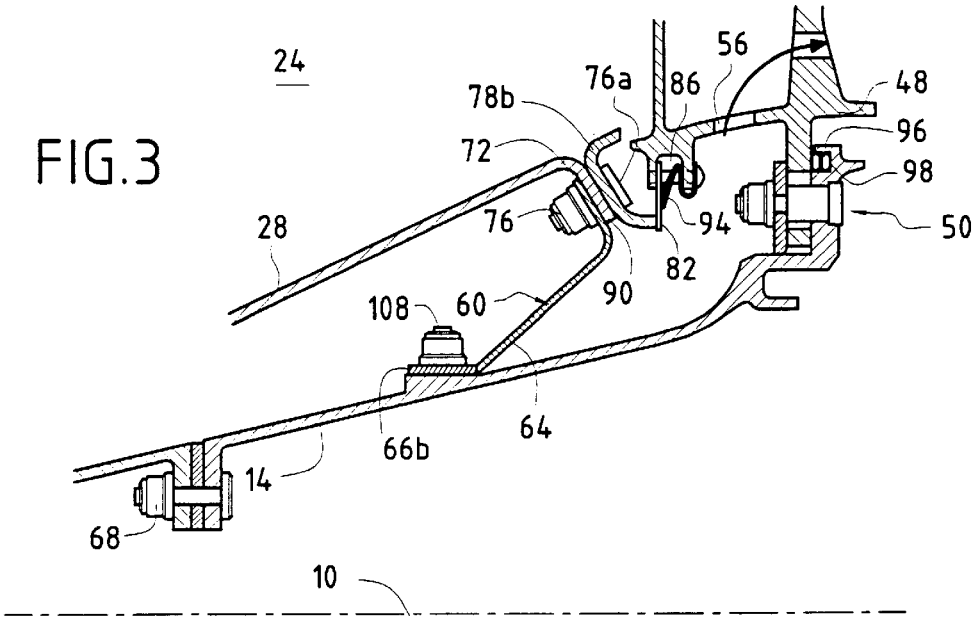

CONNECTION FOR A TWO-PART CMC CHAMBER

FIELD OF THE INVENTION

The present invention relates to the specific field of turbomachines and it relates more particularly to the problem posed by assembling a combustion chamber made of a composite material of the ceramic matrix composite (CMC) type in the metal casing of a turbomachine.

PRIOR ART

Conventionally, in a turbojet or a turboprop, the high pressure turbine, in particular its inlet nozzle (HPT nozzle), the combustion chamber, and the casing (or shell) of said chamber are all made out of the same material, generally a metal. Nevertheless, under certain particular conditions of use implementing particularly high combustion temperatures, a metal chamber turns out to be completely unsuitable from a thermal point of view and it is necessary to make use of a chamber that is based on high temperature composite materials of the CMC type. However, difficulties of implementation and materials costs mean that such materials are generally restricted to being used for the composite chamber itself, with the high pressure turbine inlet nozzle and the casing then still being made more conventionally out of metal materials. Unfortunately, metals and composites have coefficients of thermal expansion that are very different. This gives rise to particularly awkward problems of connection between the casing and the combustion chamber and of sealing at the nozzle at the inlet to the high pressure turbine.

OBJECT AND BRIEF SUMMARY OF THE INVENTION

The present invention mitigates those drawbacks by proposing a mounting for the combustion chamber in the casing with the ability to absorb the displacements induced by the various coefficients of expansion of those parts.

This object is achieved by a turbomachine comprising a shell of metal material containing in a gas flow direction F: a fuel injector assembly, a composite material combustion chamber having a longitudinal axis, and a metal nozzle forming the fixed blade inlet stage of a high pressure turbine, wherein said composite material combustion chamber is held in position inside said metal shell by a plurality of flexible metal tabs having first and second ends, said first ends being interconnected by a flange-forming metal ring fixed to said metal shell by first fixing means, and each of said second ends being fixed by second fixing means both to said composite material combustion chamber and to one end of a composite material wall whose other end forms a bearing plane for a sealing element secured to said nozzle and providing sealing for the stream of gas between said combustion chamber and said nozzle, the flexibility of said metal fixing tabs allowing expansion to take place freely in a radial direction at high temperatures between said composite material combustion chamber and said metal shell.

With this particular structure for the fixed connection, the various kinds of wear due to contact corrosion in prior art systems can be avoided. The use of a wall made of composite material placed in line with the combustion chamber to provide sealing of the stream also makes it possible to reconstitute the initial structure of the chamber. In addition, the presence of flexible metal tabs replacing the traditional flanges gives rise to a saving in mass that is particularly appreciable. In addition to being flexible, these tabs make it easy to accommodate the expansion difference that appears at high temperatures between metal parts and composite parts (by accommodating the displacements due to expansion) while still ensuring that the combustion chamber is properly held and well centered in the shell.

The first and second fixing means are preferably constituted by a plurality of bolts. Nevertheless, the second fixing means could also be constituted by crimping elements. Advantageously, said sealing element is of the circular "spring blade" gasket type. It can have a plurality of calibrated leakage orifices.

In an advantageous embodiment in which the metal shell is made up of two portions, said metal ring interconnecting said first ends of said flexible metal tabs is mounted between connecting flanges of said two portions. In an alternative embodiment, said metal ring can be fixed directly to said annular shell by conventional fixing means.

Depending on the intended embodiment, said first ends of the fixing tabs can either be fixed by brazing (or welding) to said flange-forming metal ring, or else they can be formed integrally with said metal ring.

BRIEF DESCRIPTION OF THE DRAWINGS

The characteristics and advantages of the present invention appear better from the following description made by way of non-limiting indication and with reference to the accompanying drawings, in which:

FIGS. 1A and 1B are respectively a perspective view and a section view showing details of elements in FIG. 1;

FIG. 2 is a view on a larger scale showing a portion of FIG. 1 in a first alternative connection configuration; and FIG. 3 is an enlarged view of another portion of FIG. 1 in a second alternative connection configuration.

DETAILED DESCRIPTION OF A PREFERRED EMBODIMENT

Figure 1:
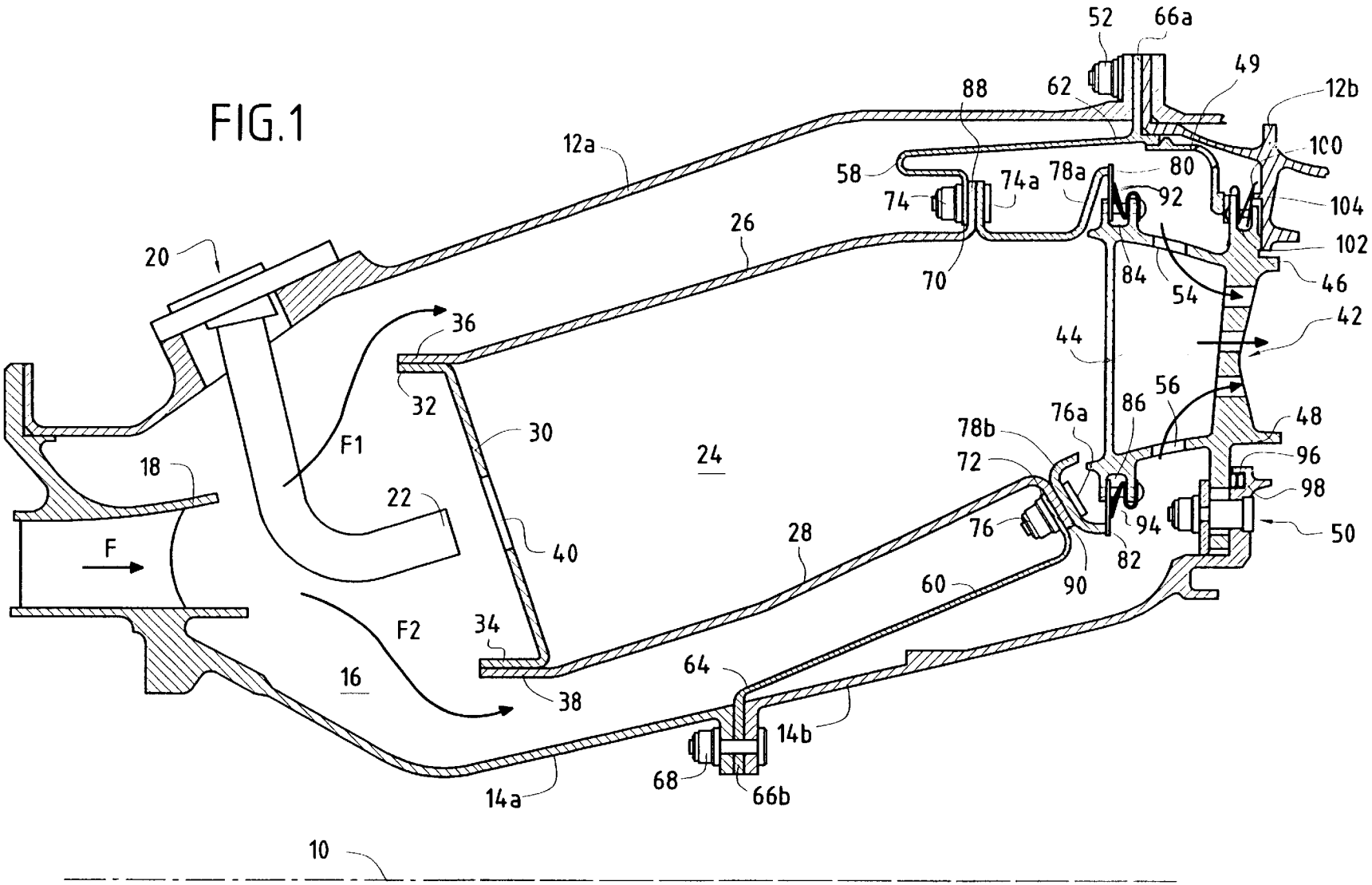
FIG. 1 is a diagrammatic axial half-section of a central zone of a turbomachine in a first embodiment of the invention.

FIG. 1 is an axial half-section view of a central portion of a turbojet or a turboprop (with the term "turbomachine" being used generically in the description below) and comprising in a first embodiment:

- an outer annular shell (or outer casing) made up of two portions 12*a* and 12*b* of metal material, having a longitudinal axis 10;
- an inner annular shell (or inner casing) that is coaxial therewith and likewise comprises two portions 14*a* and 14*b*, also made of metal material; and
- an annular space 16 extending between the two shells 12*a*, 12*b* and 14*a*, 14*b* for receiving compressed oxidizer, generally air, coming from an upstream compressor (not shown) of the turbomachine via an annular diffuser duct 18 (having a diffuser screen 18*a*) defining a general flow F of gas.

In the gas flow direction, this space 16 comprises firstly an injection assembly formed by a plurality of injection systems 20 that are regularly distributed around the duct 18, each comprising a fuel injection nozzle 22 fixed to an upstream portion 12*a* of the outer annular shell 12 (in order to simplify the drawings, the mixer and the deflector associated with each injection nozzle are omitted), followed by a combustion chamber 24 of high temperature composite material, e.g. of the CMC type or of some other type (e.g. carbon), formed by an outer axially-extending side wall 26 and an inner axially-extending side wall 28, both disposed coaxially about the axis 10, and a transversely-extending end wall 30 of said combustion chamber and which has margins 32, 34 fixed by any suitable means, e.g. metal or refractory bolts with flat head screws, to the upstream ends 36, 38 of said side walls 26, 28, this chamber end wall 30 being provided with orifices 40 specifically to enable fuel to be injected together with a fraction of the oxidizer into the combustion chamber 24, and finally an annular nozzle 42 of metal material forming an inlet stage of a high pressure turbine (not shown) and conventionally comprising a plurality of fixed blades 44 mounted between an outer circular platform 46 and an inner circular platform 48.

The nozzle is fixed to the downstream portion 14*b* of the inner annular shell of the turbomachine by first removable fixing means preferably constituted by a plurality of bolts 50, while resting on support means 49 secured to the outer annular shell of the turbomachine.

Through orifices 54, 56 formed in the outer and inner metal platforms 46 and 48 of the nozzle 42 are also provided to cool the fixed blades 46 of this nozzle at the inlet to the rotor of the high pressure turbine using compressed oxidizer available at the outlet from the diffusion duct 18 and flowing in two flows F1 and F2 on either side of the combustion chamber 24.

The combustion chamber 24 has a coefficient of thermal expansion that is very different from that of the other parts forming the turbomachine, since they are made of metal. In accordance with the invention, the combustion chamber 24 is held securely in position within its shell by a plurality of flexible tabs 58, 60 regularly distributed around the combustion chamber between the inner and outer annular shells. A first fraction of these fixing tabs (see the tab referenced 58) is mounted between the outer annular shell 12*a*, 12*b* and the outer axial wall 26 of the combustion chamber, while a second fraction (like the tab 60) is mounted between the inner annular shell 14*a*, 14*b* and the inner axial wall 28 of the combustion chamber. By way of example, the number of tabs can be a number that is equal to the number injection nozzles or to a multiple of said number.

Each flexible fixing tab of metal material can be substantially triangular in shape as shown in FIG. 1A or it can be constituted by a single blade (not shown and of optionally constant width), and it is welded or brazed at a first end 62; 64 to a metal ring 66*a*, 66*b* forming a flange and fixed securely by first fixing means 52; 68 to one or the other of the inner and outer metal annular shells (depending on where it is located). This fixing by means of a flange is intended to make it easier to hold these tabs on the metal shells. In a preferred embodiment, these tabs and the metal ring together form a single one-piece metal part.

At a second end 70; 72, each tab is fixed via second fixing means 74, 76 firstly to a downstream end 88; 90 of the outer and inner axial walls 26 and 28 of the ceramic composite material combustion chamber, and secondly to one end of a ceramic composite wall 78*a*; 78*b* lying in line with each of the outer and inner axial walls and forming a kind of second portion of the chamber. This second portion has an opposite end in the form of a bearing plane for a sealing element secured to the nozzle and providing sealing for the stream of gas between the combustion chamber 24 and the nozzle 42.

In the embodiment of the invention shown in FIG. 1, the connection between the second ends of the tabs 70, 72 and the downstream ends of the walls of the combustion chamber and the first ends of the ceramic composite walls forming the second portion of the combustion chamber is implemented merely by bolting, preferably using bolts of the captive nut type so as to facilitate assembly and disassembly and also to limit the size of the tabs. The metal ring 66*a*, 66*b* interconnecting the first ends 62, 64 of the tabs is preferably clamped between the existing connection flanges between the upstream and downstream portions 12*a* & 14*a* and 12*b* & 14*b* of the inner and outer annular shells and held securely by the first fixing means 52, 68 which are preferably likewise of the bolt type. It should be observed that ceramic composite material washers 74*a*; 76*a* are provided to enable the flat headed screws of the bolts forming the second fixing means 74; 76 to be "embedded".

The stream of gas between the combustion chamber 24 and the nozzle 42 is sealed by a circular "spring blade" gasket 80, 82 mounted in a groove 84, 86 of each of the outer and inner platforms 46 and 48 of the nozzle and which bear directly against the second end portion of the ceramic composite wall 78*a*; 78*b* forming a bearing plane for said circular sealing gasket. The gasket is pressed against said second end of the composite wall by means of a resilient element of the blade spring type 92, 94 fixed to the nozzle. By means of this disposition, perfect continuity is ensured for the hot stream between the combustion chamber 24 and the nozzle 42. Nevertheless, in order to cool the dead zone created beneath the nozzle 46 by the composite wall, calibrated leakage orifices 110 (shown only in FIG. 1B) are advantageously provided through the gaskets 80, 82.

The gas flows between the combustion chamber and the turbine are sealed firstly by an omega type circular sealing gasket 96 mounted in a circular groove 98 of a flange of the inner annular shell 14 in direct contact with the inner circular platform 48 of the nozzle, and secondly by another circular spring blade gasket 100 mounted in a circular groove 102 of the outer circular platform of the nozzle 46 and having one end in direct contact with a circular projection 104 on the downstream portion 12*b* of the outer annular shell.

FIG. 1B shows a first variant of the preceding embodiment in which the tabs at the downstream end 90 of the combustion chamber 24 are fixed (only the tab 60 is shown) by a crimped connection, the bolts 76 being replaced by crimping elements 76*b*. With this configuration, it is possible to perform cooling through the crimping element so there is no need to provide calibrated orifices through the spring blade gaskets 80, 82.

In the variant shown in FIG. 2, the flange-forming metal ring 66*a* interconnecting the first ends 62 of the fixing tabs 58 of the outer axial wall of the combustion chamber 26 by brazing (or welding) is no longer mounted between flanges but is itself brazed (or welded) to a centered keying element 106 bearing against the outer annular shell 12.

In another variant shown in FIG. 3, the flange-forming metal ring 66*b* interconnecting the first ends 64 of the fixing tabs 60 of the inner axial wall of the combustion chamber 28 by brazing (or welding) is no longer mounted between flanges but is merely fixed directly to the inner annular shell 14 by conventional fixing means 108, e.g. of the bolt type.

In all of the above-described configurations, the flexibility of the fixing tabs makes it possible to accommodate the thermal expansion difference that appears at high temperatures between the composite material combustion chamber and the metal annular shells, while continuing to hold and position the combustion chamber.

What is claimed is:

1. A turbomachine comprising a shell of metal material containing in a gas flow direction F: a fuel injector assembly, a composite material combustion chamber having a longitudinal axis, and a metal nozzle forming the fixed blade inlet stage of a high pressure turbine, wherein said composite material combustion chamber is held in position inside said metal shell by a plurality of flexible metal tabs having first and second ends, said first ends being interconnected by a flange-forming metal ring fixed to said metal shell by first fixing means, and each of said second ends being fixed by second fixing means both to said composite material combustion chamber and to one end of a composite material wall whose other end forms a bearing plane for a sealing element secured to said nozzle and providing sealing for the stream of gas between said combustion chamber and said nozzle, the flexibility of said metal fixing tabs allowing expansion to take place freely in a radial direction at high temperatures between said composite material combustion chamber and said metal shell.

2. A turbomachine according to claim 1, wherein said first and second fixing means are constituted by a plurality of bolts.

3. A turbomachine according to claim 1, wherein said metal shell is made up of two portions, and said metal ring interconnecting said first ends of said flexible metal tabs is mounted between the connection flanges of said two portions.

4. A turbomachine according to claim 1, wherein said metal ring interconnecting said first ends of said flexible metal tabs is fixed directly to said annular shell by conventional fixing means.

5. A turbomachine according to claim 1, wherein said first ends of the flexible metal tabs are fixed by brazing (or welding) to said flange-forming metal ring.

6. A turbomachine according to claim 1, wherein said first ends of the flexible metal tabs are integrally formed with said flange-forming metal ring.

7. A turbomachine according to claim 1, wherein said second fixing means are constituted by crimping elements.

8. A turbomachine according to claim 1, wherein said sealing element is of the circular spring blade gasket type.

9. A turbomachine according to claim 8, wherein said spring blade gasket includes a plurality of calibrated leakage orifices.

* * * * *